US009779711B2

(12) United States Patent
Ohnishi et al.

(10) Patent No.: US 9,779,711 B2
(45) Date of Patent: Oct. 3, 2017

(54) INSTALLATION STRUCTURE FOR ACOUSTIC TRANSDUCER AND MUSICAL INSTRUMENT

(71) Applicant: YAMAHA CORPORATION, Hamamatsu-shi (JP)

(72) Inventors: Kenta Ohnishi, Hamamatsu (JP); Shinji Sumino, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/301,980

(22) PCT Filed: Apr. 9, 2015

(86) PCT No.: PCT/JP2015/061083
§ 371 (c)(1),
(2) Date: Oct. 5, 2016

(87) PCT Pub. No.: WO2015/156348
PCT Pub. Date: Oct. 15, 2015

(65) Prior Publication Data

US 2017/0125001 A1 May 4, 2017

(30) Foreign Application Priority Data

Apr. 9, 2014 (JP) ..... 2014-080507

(51) Int. Cl.
*G10H 3/14* (2006.01)
*G10H 1/32* (2006.01)

(52) U.S. Cl.
CPC ..... *G10H 3/146* (2013.01); *G10H 1/32* (2013.01)

(58) Field of Classification Search
CPC ..... G10H 3/146; G10H 1/32
(Continued)

(56) References Cited

U.S. PATENT DOCUMENTS 6,965,679 B1 11/2005 Lopez Bosio et al.
7,085,391 B1 8/2006 Yamaya
(Continued)

FOREIGN PATENT DOCUMENTS

DE 3831187 A1 3/1990
EP 1227700 A1 7/2002
(Continued)

OTHER PUBLICATIONS

International Preliminary Report on Patentability issued in International Application No. PCT/JP2015/061083, mailed Oct. 20, 2016.
(Continued)

*Primary Examiner* — Jeffrey Donels
(74) *Attorney, Agent, or Firm* — Rossi, Kimms & McDowell LLP

(57) ABSTRACT

An installation structure for an acoustic transducer configured to vibrate a vibrated body in a first direction so as to permit the vibrated body to generate sounds, wherein the acoustic transducer includes: a magnetic-path forming portion that forms a magnetic path; a vibrating unit configured to vibrate in the first direction; and a connecting unit connecting the vibrating unit and the vibrated body to transmit vibration of the vibrating unit to the vibrated body, wherein the magnetic-path forming portion has a through-hole penetrating therethrough in the first direction from a first opening to a second opening, the connecting unit passing through the through-hole, wherein the vibrating unit is disposed on a first-opening side of the magnetic-path forming portion and is fixed to the connecting unit on the first-opening side, and wherein the vibrated body is connected to the connecting unit on a second-opening side of the magnetic-path forming portion.

15 Claims, 8 Drawing Sheets

(58) Field of Classification Search
USPC ..... 84/725
See application file for complete search history.

(56) References Cited

U.S. PATENT DOCUMENTS

| | | | | |
|---|---|---|---|---|
| 9,373,314 | B2 | 6/2016 | Takahashi et al. | |
| 2006/0115107 | A1 | 6/2006 | Vincent et al. | |
| 2013/0061733 | A1 | 3/2013 | Ohnishi et al. | |
| 2013/0092007 | A1 | 4/2013 | Ohnishi et al. | |
| 2013/0118333 | A1 | 5/2013 | Ohnishi et al. | |
| 2014/0202318 | A1* | 7/2014 | Ohnishi | G10C 3/06 84/723 |
| 2015/0128790 | A1 | 5/2015 | Ohnishi et al. | |
| 2015/0163571 | A1* | 6/2015 | Satomi | G10H 1/32 381/162 |
| 2015/0206514 | A1* | 7/2015 | Ohnishi | G10C 3/06 84/725 |
| 2015/0356961 | A1* | 12/2015 | Takahashi | G10H 1/32 84/644 |
| 2016/0035331 | A1* | 2/2016 | Murakami | G10C 3/06 84/726 |

FOREIGN PATENT DOCUMENTS

| | | | |
|---|---|---|---|
| EP | 2571016 | A2 | 3/2013 |
| EP | 2793221 | A1 | 10/2014 |
| JP | S59500531 | A | 3/1984 |
| JP | H04500735 | A | 2/1992 |
| JP | 2000315088 | A | 11/2000 |
| JP | 2008298992 | A | 12/2008 |
| JP | 2010007835 | A | 1/2010 |
| JP | 2012230406 | A | 11/2012 |
| JP | 2013077000 | A | 4/2013 |
| TW | 466468 | B | 12/2001 |
| WO | 8303022 | A1 | 9/1983 |
| WO | 9003025 | A1 | 3/1990 |
| WO | 0054250 | A1 | 9/2000 |
| WO | 2011158434 | A1 | 12/2011 |

OTHER PUBLICATIONS

Written Opinion issued in International Application No. PCT/JP2013/085055 mailed Mar. 4, 2014.
Office Action issued in U.S. Appl. No. 14/762,611, mailed Nov. 10, 2015.
Office Action issued in Tawainese Application No. 102147003 mailed Mar. 24, 2015. English translation provided.
International Search Report issued in International Application No. PCT/JP2015/061083 mailed Jul. 7, 2015. English translation provided.
International Search Report issued in International Application No. PCT/JP2013/085055 mailed Mar. 4, 2014. English translation provided.
European Search Report issued in European Application No. 13872580.9. mailed Sep. 28, 2016.
Written Opinion issued in International Application No. PCT/JP2015/061083 mailed Jul. 7, 2015.
Office Action issued in Chinese Patent Application No. 201380071180.6 dated Jul. 5, 2017. English translation provided.

* cited by examiner

INSTALLATION STRUCTURE FOR ACOUSTIC TRANSDUCER AND MUSICAL INSTRUMENT

TECHNICAL FIELD

The present invention relates to an installation structure for an acoustic transducer and a musical instrument including the same.

BACKGROUND ART

Various conventional musical instruments such as keyboard musical instruments include an acoustic transducer installed thereon. The acoustic transducer is configured to vibrate a vibrated body such as a soundboard in a predetermined direction so as to permit the vibrated body to generate sounds. Such an acoustic transducer includes a magnetic-path forming portion that forms a magnetic path and a vibrating unit provided so as to protrude from the magnetic-path forming portion. The vibrating unit is configured to vibrate in a protrusion direction in which the vibrating unit protrudes from the magnetic-path forming portion.

The following Patent Literatures 1 and 2 disclose an installation structure for an acoustic transducer in which the magnetic-path forming portion is fixed to a back post or the like and a distal end portion of the vibrating unit in the protrusion direction is fixed to the vibrated body by bonding, for instance. In this arrangement, when the vibrating unit is vibrated with respect to the magnetic-path forming portion, the vibrated body vibrates in the predetermined direction, whereby sounds are generated by vibration of the vibrated body.

CITATION LIST

Patent Literature

Patent Literature 1: Japanese Unexamined Patent Application Publication No. 2013-077000

Patent Literature 2: Japanese Unexamined Patent Application Publication (Translation of PCT Application) No. 04-500735

SUMMARY

Technical Problem

In the meantime, the vibrated body such as the soundboard of the musical instrument may undergo dimensional changes and deformation caused by deterioration over years due to influences of the temperature and the humidity. Particularly when the vibrated body is displaced in a direction perpendicular to a vibration direction (predetermined direction) in which the vibrated body vibrates, the vibrating unit of the acoustic transducer fixed to the vibrated body is displaced in the perpendicular direction with respect to the magnetic-path forming portion. In this case, noise may be mixed in sounds generated by vibration of the vibrated body. When an amount of the displacement becomes excessively large, the vibrating unit and the magnetic-path forming portion may physically contact each other, so that there may be caused a risk that the vibrating unit does not appropriately vibrate with respect to the magnetic-path forming portion.

The present invention has been developed in view of the situations described above. It is an object of the invention to provide an installation structure for an acoustic transducer which is capable of reducing a displacement amount of the vibrating unit with respect to the magnetic-path forming portion even when a vibrated body undergoes displacement in the perpendicular direction due to deterioration over years. It is also an object to provide a musical instrument including the installation structure for the acoustic transducer.

Solution to Problem

The object indicated above may be attained according to one aspect of the invention, which provides an installation structure for an acoustic transducer configured to vibrate a vibrated body in a first direction so as to permit the vibrated body to generate sounds, wherein the acoustic transducer includes: a magnetic-path forming portion that forms a magnetic path; a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the magnetic-path forming portion has a through-hole penetrating therethrough in the first direction from a first opening to a second opening, the connecting unit passing through the through-hole, wherein the vibrating unit is disposed on a first-opening side of the magnetic-path forming portion which is one of opposite sides of the magnetic-path forming portion on which the first opening is located, and the vibrating unit is fixed to the connecting unit on the first-opening side, and wherein the vibrated body is connected to the connecting unit on a second-opening side of the magnetic-path forming portion which is the other of the opposite sides of the magnetic-path forming portion on which the second opening is located.

The object indicated above may also be attained according to another aspect of the invention, which provides an installation structure for an acoustic transducer configured to vibrate a vibrated body in a first direction so as to permit the vibrated body to generate sounds, wherein the acoustic transducer includes: a magnetic-path forming portion that forms a magnetic path; a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the magnetic-path forming portion has a through-hole penetrating therethrough in the first direction from a first opening to a second opening, the connecting unit passing through the through-hole, wherein the connecting unit is fixed to the vibrating unit on a first-opening side of the magnetic-path forming portion which is one of opposite sides of the magnetic-path forming portion on which the first opening is located, and wherein the connecting unit is connected to the vibrated body on a second-opening side of the magnetic-path forming portion which is the other of the opposite sides of the magnetic-path forming portion on which the second opening is located.

According to the installation structure for the acoustic transducer constructed as described above, the vibrating unit protrudes from the magnetic-path forming portion in a direction away from the vibrated body. In other words, the acoustic transducer is disposed such that its orientation is inverted or reversed with respect to an orientation in which acoustic transducers are conventionally disposed. In the thus oriented acoustic transducer, the vibrating unit and the vibrated body are connected to each other by the connecting unit that passes through the through-hole of the magnetic-path forming portion. In the present installation structure, it is consequently possible to increase a distance between a position at which the vibrating unit is attached to the magnetic-path forming portion and a position at which the vibrating unit (the connecting unit) is connected to the vibrated body, as compared with the conventional arrangement. Thus, even if the vibrated body undergoes displacement in a direction perpendicular to the first direction due to deterioration over years, for instance, it is possible to reduce an amount of displacement of the vibrating unit with respect to the magnetic-path forming portion.

In the installation structure for the acoustic transducer constructed as described above, the vibrating unit may be fixed to a first protruding portion of the connecting unit that protrudes from the first opening, and the vibrated body may be connected to a distal end of a second protruding portion of the connecting unit that protrudes form the second opening.

In the installation structure for the acoustic transducer constructed as described above, the vibrating unit may be removably fixed to the first protruding portion.

According to the installation structure for the acoustic transducer constructed as described above, a position at which the vibrating unit and the connecting unit are fixed is not located between the magnetic-path forming portion and the vibrated body. Thus, the magnetic-path forming portion and the vibrating unit can be easily attached to and removed from the connecting unit In the installation structure for the acoustic transducer constructed as described above, the vibrating unit may be supported by the magnetic-path forming portion through a damper portion on the first-opening side of the magnetic-path forming portion.

In the installation structure for the acoustic transducer constructed as described above, the acoustic transducer may further include a restrictor that is held in engagement with the second protruding portion that protrudes from the second opening, the restrictor being configured to restrict a movement of the second protruding portion in a direction intersecting the first direction while allowing a movement of the second protruding portion in the first direction, at a position at which the restrictor is held in engagement with the second protruding portion.

According to the installation structure for the acoustic transducer constructed as described above, the first protruding portion of the connecting unit is supported by the damper portion together with the vibrating unit, and the second protruding portion of the connecting unit is supported by the restrictor. In other words, the connecting unit is supported at mutually different two positions in the first direction. In this arrangement, even if a distance between the magnetic-path forming portion and the vibrated body is small, a distance between a portion of the connecting unit at which the connecting unit is supported by the damper portion and a portion of the connecting unit at which the connecting unit is supported by the restrictor can be made large.

Consequently, even when the vibrated body undergoes the displacement in the perpendicular direction due to deterioration over years and the connecting unit accordingly receives an external force to incline the connecting unit with respect to the first direction, the connecting unit is prevented from being inclined by the damper portion and the restrictor. That is, the axis of the connecting unit and the axis of the vibrating unit fixed to the connecting unit can be prevented from inclining with respect to the first direction. Thus, it is possible to further reduce the displacement amount of the vibrating unit with respect to the magnetic-path forming portion.

In the installation structure for the acoustic transducer constructed as described above, the connecting unit may include a distal joint portion provided at the distal end of the second protruding portion to which the vibrated body is connected, the distal joint portion being configured to allow an axis of the connecting unit to incline with respect to the first direction.

In the installation structure for the acoustic transducer constructed as described above, the connecting unit may include: a vibrating-side shaft portion passing through the through-hole of the magnetic-path forming portion and including the first protruding portion and a proximal end portion of the second protruding portion in a protrusion direction in which the second protruding portion protrudes; a vibrated-side shaft portion protruding from the vibrated body toward the magnetic-path forming portion and including a distal end portion of the second protruding portion in the protrusion direction; and an intermediate joint portion connecting the vibrating-side shaft portion and the vibrated-side shaft portion to each other and configured to allow an axis of the vibrating-side shaft portion and an axis of the vibrated-side shaft portion to incline relative to each other.

In an instance where the present installation structure for the acoustic transducer includes one of the distal joint portion and the intermediate joint portion, the axis of the vibrating unit is allowed to incline with respect to the first direction when the vibrated body undergoes the displacement in the perpendicular direction due to deterioration over years or the like. In the present installation structure for the acoustic transducer, the distance between the position at which the vibrating unit is attached to the magnetic-path forming portion and the position at which the vibrating unit (the connecting unit) is fixed to the vibrated body is fixed is longer, as compared with the conventional arrangement. Consequently, an angle of inclination of the axis of the vibrating unit with respect to the first direction can be made smaller, as compared with the conventional arrangement.

In an instance where the present installation structure for the acoustic transducer includes both of the distal joint portion and the intermediate joint portion, the axis of the vibrated-side shaft portion inclines with respect to both of the first direction and the axis of the vibrating-side shaft portion when the vibrated body undergoes the displacement in the perpendicular direction due to deterioration over years or the like. As a result, it is possible to prevent the axis of the vibrating-side shaft portion from inclining with respect to the first direction. That is, it is possible to prevent the axis of the vibrating unit fixed to the vibrating-side shaft portion of the connecting unit from inclining with respect to the first direction. Consequently, the displacement amount of the vibrating unit with respect to the magnetic-path forming portion can be further reduced.

The installation structure for the acoustic transducer of the present invention is may be configured as follows: An installation structure for an acoustic transducer configured to vibrate a vibrated body in a first direction so as to permit the vibrated body to generate sounds, wherein the acoustic transducer includes: a magnetic-path forming portion that forms a magnetic path; a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the magnetic-path forming portion has a through-hole penetrating therethrough in the first direction from a first opening to a second opening, the connecting unit passing through the through-hole, wherein the connecting unit is fixed to the vibrating unit on a first-opening side of the magnetic-path forming portion which is one of opposite sides of the magnetic-path forming portion on which the first opening is located, and wherein the connecting unit is connected to the vibrated body on a second-opening side of the magnetic-path forming portion which is the other of the opposite sides of the magnetic-path forming portion on which the second opening is located.

The object indicated above may also be attained according to still another aspect of the invention, which provides a musical instrument according to the present invention may include: a vibrated body configured to generate sounds by vibration thereof in the first direction; and the installation structure for the acoustic transducer constructed as described above.

Advantageous Effects

According to the present invention, even when the vibrated body undergoes the displacement in the perpendicular direction, the displacement amount of the vibrating unit with respect to the magnetic-path forming portion can be made small.

DESCRIPTION OF THE EMBODIMENTS

Referring to FIGS. 1 to 8, there will be explained one embodiment of the present invention. In the present embodiment, a piano 1 which is one of keyboard musical instruments is illustrated as a musical instrument to which is applied an installation structure for an acoustic transducer according to one embodiment of the present invention. In FIGS. 1 to 8, a right-left direction, a front-rear direction, and an up-down direction as seen from a player of the piano 1 are respectively defined as an X-axis direction, a Y-axis direction, and a Z-axis direction.

Figure 1:
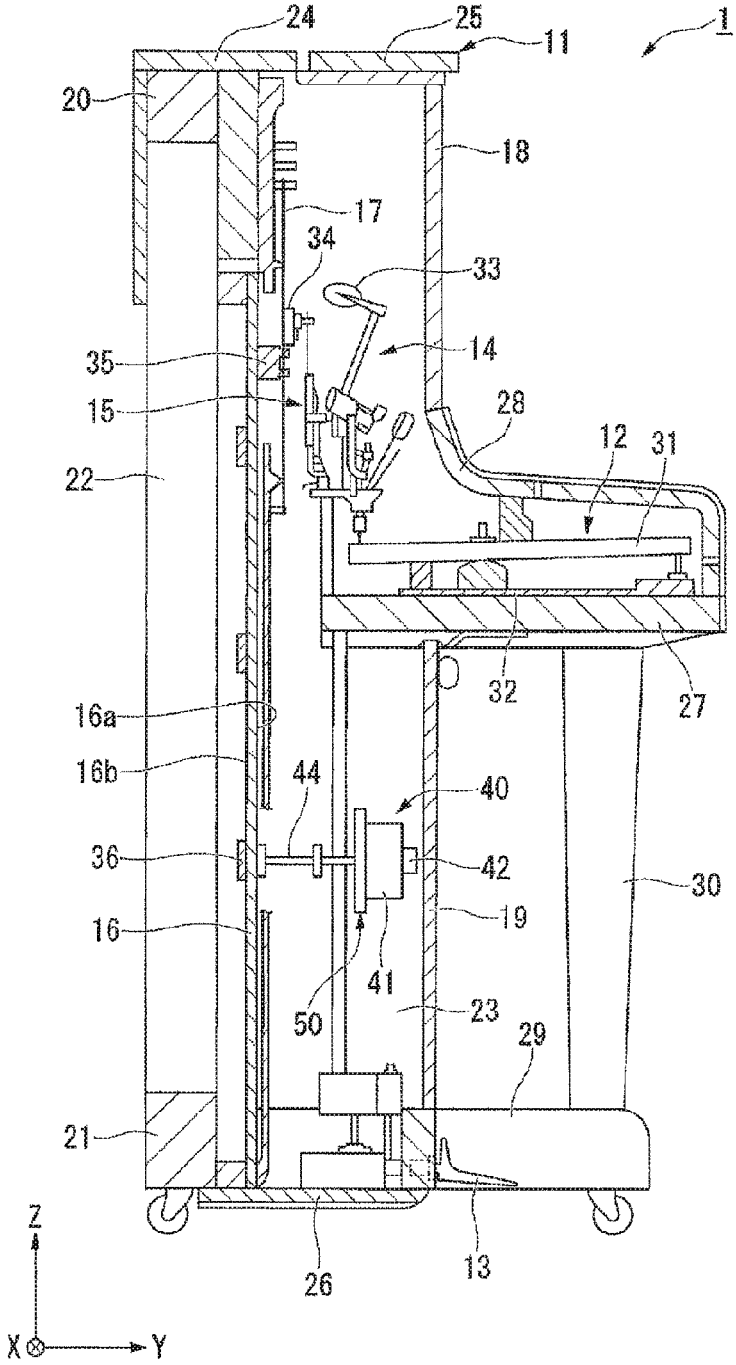
FIG. 1 is a side sectional view of a piano including an installation structure for an acoustic transducer according to one embodiment of the present invention.

As shown in FIG. 1, the piano 1 of the present embodiment is an upright piano which is one sort of an acoustic piano. The piano 1 includes a housing 11, a keyboard portion 12, pedals 13, action mechanisms 14, damper mechanisms 15, a soundboard 16 (as one example of a vibrated body), and strings 17.

The housing 11 includes an upper front panel 18, a lower front panel 19, a rear-side upper beam 20, a rear-side lower beam 21, back posts 22, a pair of side boards 23, a rear roof 24, a front roof 25, a bottom plate 26, a key bed 27, a front rail 28, a pair of toe blocks 29, and a pair of legs 30.

The upper front panel 18 and the lower front panel 19 constitute a front surface of the housing 11 and are spaced apart from each other in the up-down direction (the Z-axis direction).

The rear-side upper beam 20 is disposed on a rear-surface side of the housing 11 so as to be opposed to an upper end portion of the upper front panel 18. The rear-side upper beam 20 extends in the right-left direction (the X-axis direction). The rear-side lower beam 21 is disposed on the rear-surface side of the housing 11 so as to be opposed to a lower end portion of the lower front panel 19. The rear-side lower beam 21 extends in the right-left direction.

The back posts 22 are provided between the rear-side upper beam 20 and the rear-side lower beam 21 so as to extend in the up-down direction. In the side sectional view of the piano 1 shown in FIG. 1, only one back post 22 is seen. A plurality of back posts 22 are arranged so as to be spaced apart from one another in the right-left direction.

The pair of side boards 23 sandwich the upper front panel 18, the lower front panel 19, the rear-side upper beam 20, and the rear-side lower beam 21 in the right-left direction. The side boards 23 are disposed at one and the other end of the piano 1 in the right-left direction. Only one side board 23 is seen in the side sectional view of the piano 1 shown in FIG. 1.

The rear roof 24 and the front roof 25 are disposed so as to contact respective upper ends of the upper front panel 18, the rear-side upper beam 20, and the side boards 23.

The bottom plate 26 is disposed so as to contact respective lower ends of the lower front panel 19, the rear-side lower beam 21, and the side boards 23.

The key bed 27 and the front rail 28 protrude forward (in a positive direction of the Y axis) from an opening defined by a lower end of the upper front panel 18, an upper end of the lower front panel 19, and inner wall surfaces of the side boards 23.

The pair of toe blocks 29 protrude forward respectively from right and left ends of a lower portion of the lower front panel 19. The pair of legs 30 extend between a lower surface of the key bed 27 and the corresponding toe blocks 29.

The keyboard portion 12 has a plurality of keys 31 which are arranged in the right-left direction and which are operated by fingers of the player for performance. Each key 31 is pivotally disposed on the key bed 27 via a key frame 32. A front end portion of each key 31 is exposed to the exterior on a front-surface side of the housing 11 (i.e., the right side in FIG. 1).

The pedals 13 are disposed at the lower end of the lower front panel 19 of the housing 11 and are operated by a foot of the player.

The action mechanism 14 and the damper mechanism 15 are provided for each key 31 and are disposed above a rear end portion of the corresponding key 31.

The action mechanism 14 is a mechanism for converting a force by which the key 31 is depressed by a finger of the player (key depression force) into a force by which the string 17 is struck by a hammer 33 (string striking force or hitting force).

The damper mechanism 15 is a mechanism for converting the key depression force and a force by which a damper pedal (which is one of the pedals 13) is stepped on by a foot of the player (stepping force) into a force by which the dampers 34 on the strings 17 are released therefrom (string release force). The damper mechanisms 15 are disposed together with the action mechanisms 14 in a region in the housing 11 defined by the upper front panel 18, the front rail 28, and the soundboard 16 which will be explained later.

The soundboard 16 is disposed in a region in the housing 11 enclosed by the upper front panel 18, the lower front panel 19, the side boards 23, the rear roof 24, the front roof 25, and the bottom plate 26. Specifically, the soundboard 16 is disposed near to the back posts 22 in the region in the housing 11, such that the soundboard 16 is opposed to the upper front panel 18 and the lower front panel 19 in the front-rear direction (the Y-axis direction).

The strings 17 are provided so as to correspond to the keys 31 and are stretched over an inner surface 16*a* of the soundboard 16 that faces the upper front panel 18 and the lower front panel 19.

There are provided, on the inner surface 16*a* of the soundboard 16, bridges 35 engaging with a part of the strings 17. There are provided soundboard ribs 36 on an outer surface of the soundboard 16 that faces the back posts 22.

In the thus constructed piano 1, when one string 17 is struck by the hammer 33 and is accordingly vibrated, the vibration of the one string 17 is transmitted to the soundboard 16 via the bridges 35 and the soundboard 16 is accordingly vibrated. The vibration of the soundboard 16 propagates through the air, so that sounds are generated. That is, the soundboard 16 generates sounds by being vibrated. The vibration of the soundboard 16 is also transmitted to other strings 17 via the bridges 35, so that other strings 17 are vibrated.

The soundboard 16 is vibrated in the thickness direction thereof (the Y-axis direction). In the following explanation, the direction of the vibration of the soundboard 16 will be referred to as "predetermined direction".

The piano 1 of the present embodiment has an acoustic transducer 40 configured to vibrate the soundboard 16 in the predetermined direction (that coincides with the Y-axis direction and is one example of a first direction), so as to permit the soundboard 16 to generate sounds. Hereinafter, the acoustic transducer 40 will be explained referring to FIGS. 3 and 4.

Figure 3:
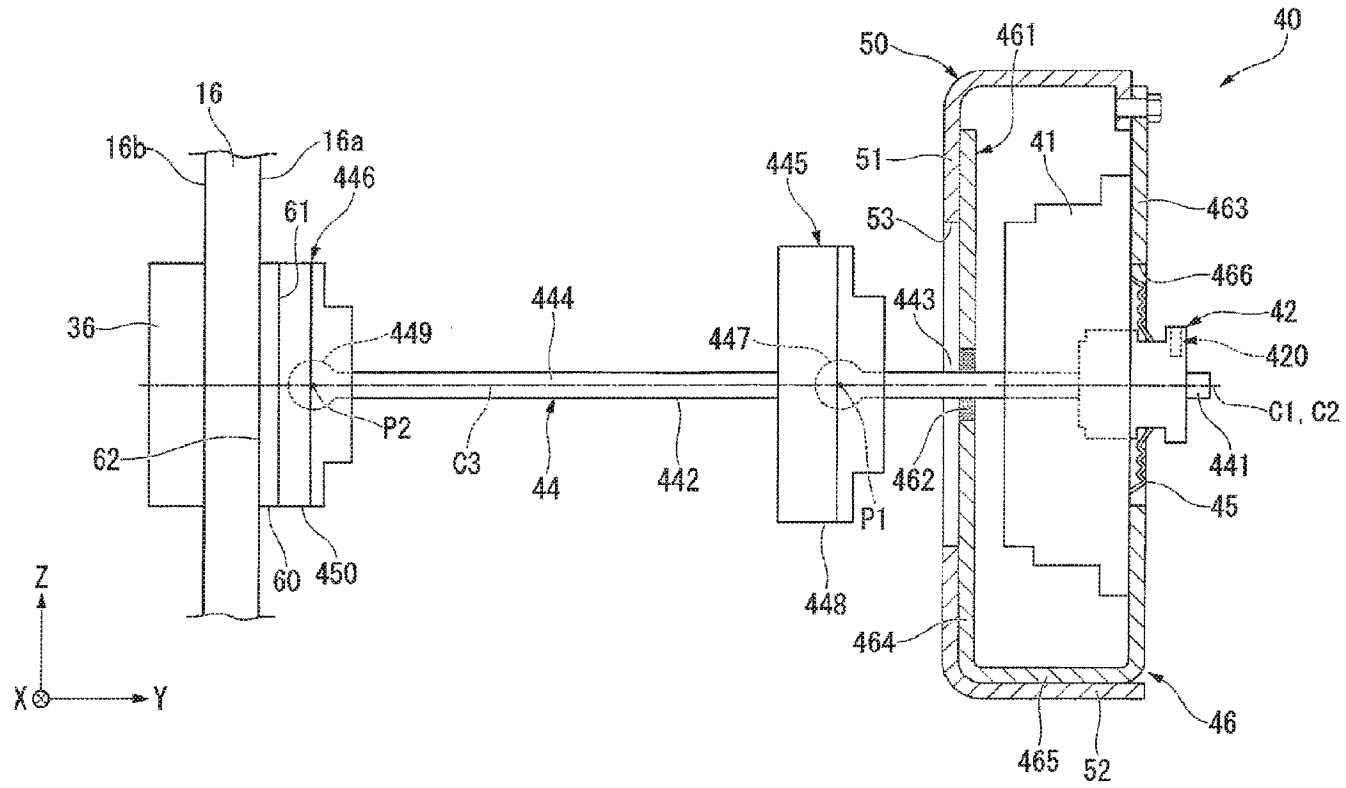
FIG. 3 is a cross-sectional view taken along the line in FIG. 2.
Figure 4:
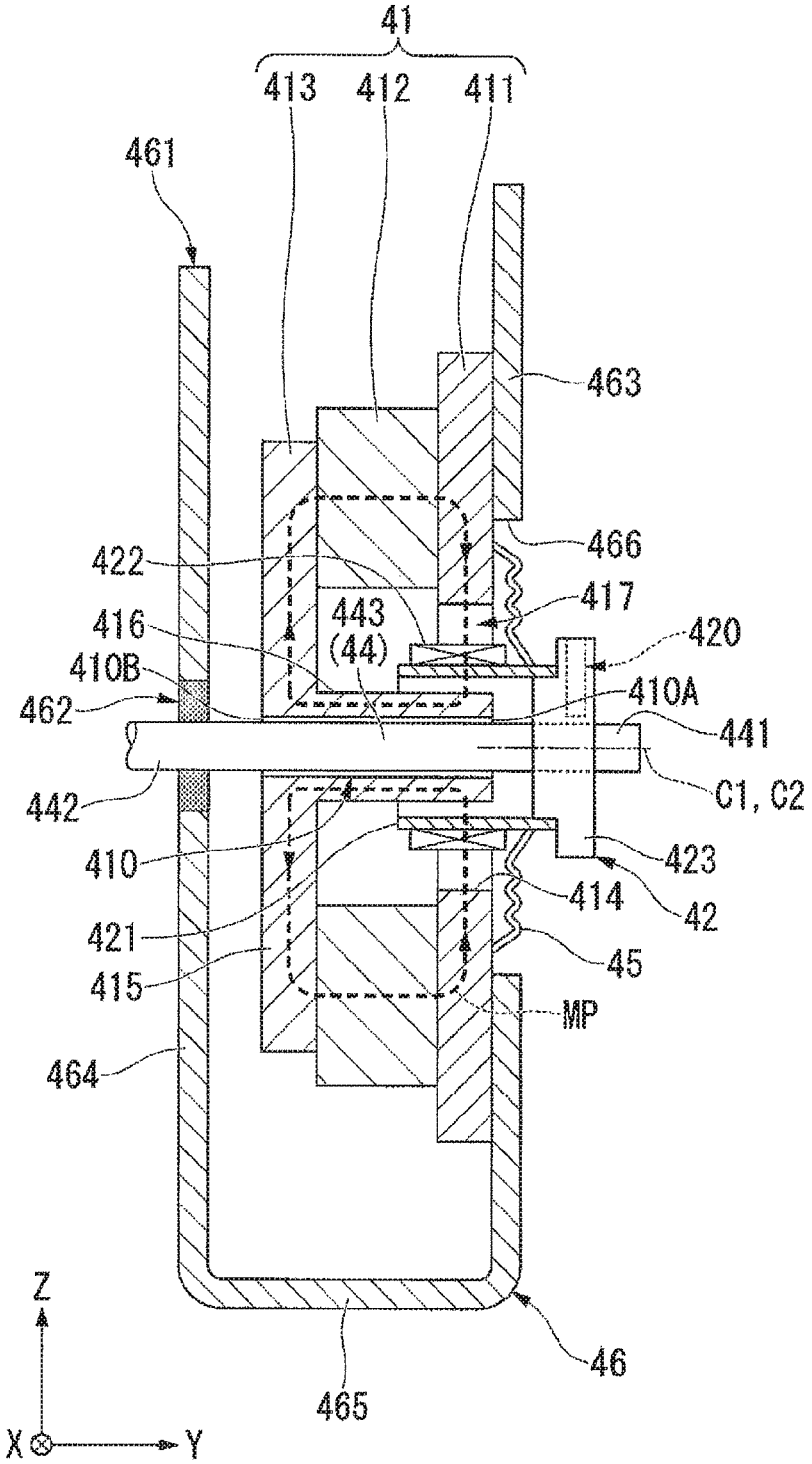
FIG. 4 is an elevational view in vertical cross section of the acoustic transducer shown in FIG. 3.
Figure 5:
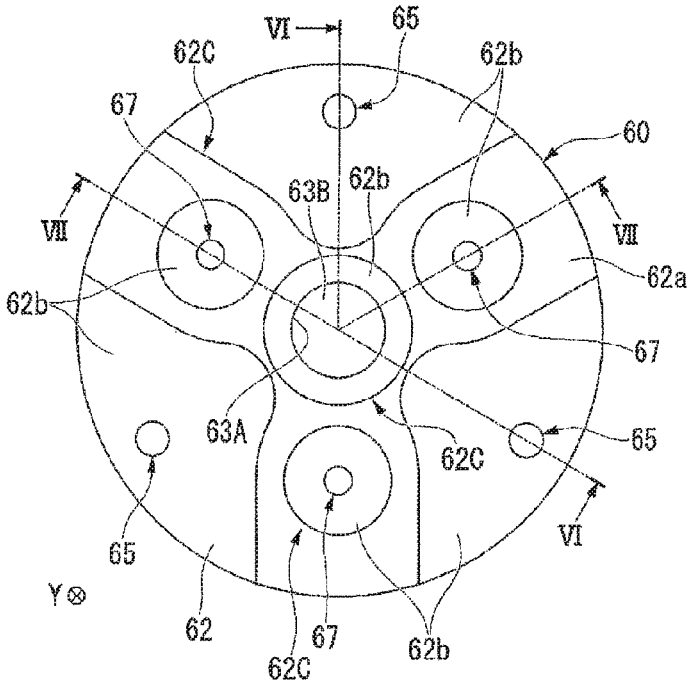
FIG. 5 is a plan view of an intervening member shown in FIG. 3 disposed between a connecting unit and a soundboard, as seen from the soundboard side.
Figure 6:
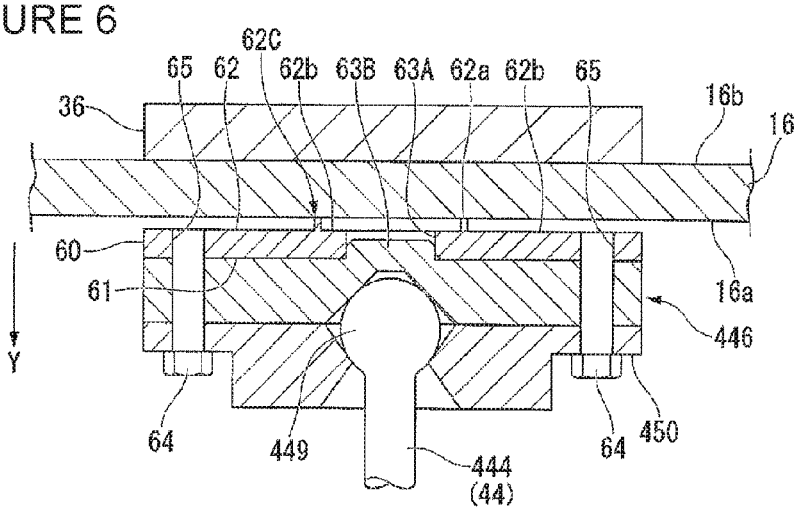
FIG. 6 is a cross-sectional view taken along the line VI-VI in FIG. 5.
Figure 7:
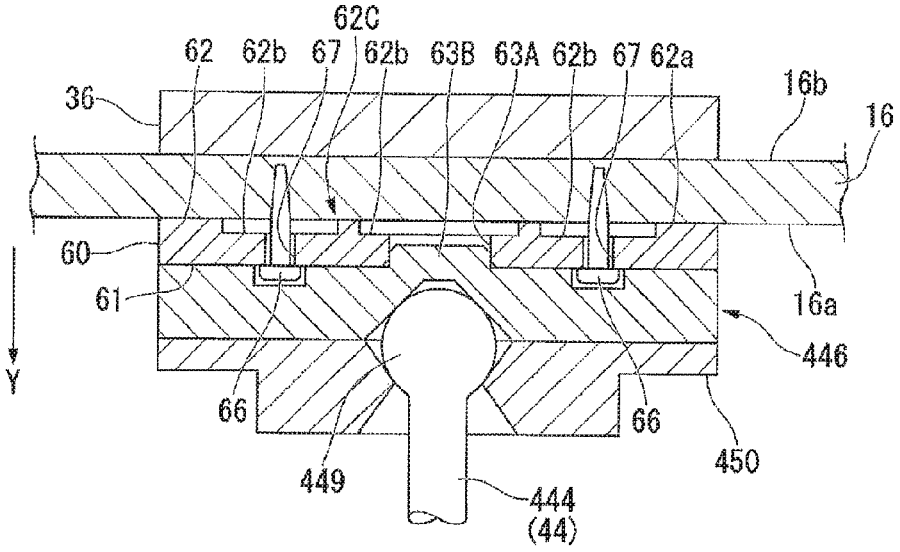
FIG. 7 is a cross-sectional view taken along the line VII-VII in FIG. 5.

As shown in FIGS. 3 and 4, the acoustic transducer 40 is an actuator of a voice coil type and includes a magnetic-path forming portion 41, a vibrating unit 42, and a connecting unit 44.

The magnetic-path forming portion 41 forms a magnetic path. An insertion hole 410 (as one example of a through-hole) is formed through the magnetic-path forming portion 41 in the predetermined direction (the Y-axis direction) for permitting the connecting unit 44 to pass through the insertion hole 410.

As shown in FIG. 4, the magnetic-path forming portion 41 of the present embodiment includes a top plate 411, a magnet 412, and a yoke 413.

The top plate 411 is formed of a soft magnetic material such as soft iron. The top plate 411 is shaped like a disc and has a through-hole 414 at its center.

The yoke 413 is formed of a soft magnetic material such as soft iron and is integrally constituted by a disc portion 415 and a cylindrical portion 416 that protrudes from the center of the disc portion 415. The axis of the disc portion 415 and the axis of the cylindrical portion 416 coincide with each other. The cylindrical portion 416 has an outer diameter smaller than an inner diameter of the through-hole 414 of the top plate 411. The above-indicated insertion hole 410 of the magnetic-path forming portion 41 is formed through the disc portion 415 and the cylindrical portion 416 of the yoke 413 in the axis direction thereof.

The magnet 412 is a permanent magnet having an annular shape. The magnet 412 has an inner diameter larger than the inner diameter of the through-hole 414 of the top plate 411.

The magnet 412 is fixed to the disc portion 415 of the yoke 413 in a state in which the cylindrical portion 416 of the yoke 413 passes through the magnet 412. The top plate 411 is fixed to the magnet 412 such that the magnet 412 is sandwiched between the top plate 411 and the disc portion 415 of the yoke 413 and such that a distal end portion of the cylindrical portion 416 is disposed in the through-hole 414 of the top plate 411.

In a state in which the top plate 411, the magnet 412, and the yoke 413 are fixed with one another, the axes thereof coincide with one another and define an axis C1 of the magnetic-path forming portion 41.

In the thus constructed magnetic-path forming portion 41 of the present embodiment, there is formed a magnetic path MP that passes the top plate 411, the cylindrical portion 416, and the disc portion 415 in order from the magnet 412 and returns to the magnet 412. In this arrangement, there is generated, between the inner circumferential surface of the through-hole 414 of the top plate 411 and the outer circumferential surface of the cylindrical portion 416 of the yoke 413, a magnetic field including a component in the diametrical direction of the cylindrical portion 416. That is, a space between the inner circumferential surface of the through-hole 414 of the top plate 411 and the outer circumferential surface of the cylindrical portion 416 of the yoke 413 functions as a magnetic space 417 in which the magnetic field indicated above is generated.

The vibrating unit 42 is provided so as to vibrate with respect to the magnetic-path forming portion 41 in the predetermined direction (that is the Y-axis direction and one example of the first direction). The vibrating unit 42 is disposed on a first-opening side of the magnetic-path forming portion 41 which is one of opposite sides of the magnetic-path forming portion 41 on which a first opening 410A of the insertion hole 410 is located. The vibrating unit 42 is supported by the magnetic-path forming portion 41 through a damper portion 45. The vibrating unit 42 is removably fixed to the connecting unit 44 by fixing means 420. The vibrating unit 42 of the present embodiment will be explained below in detail. The insertion hole 410 is a through-hole that penetrates the magnetic-path forming portion 41 in the predetermined direction from the first opening 410A of the magnetic-path forming portion 41 to a second opening 410B of the magnetic-path forming portion 41.

The vibrating unit 42 of the present embodiment includes a bobbin 421, a voice coil 422, and a cap 423.

The bobbin 421 has a cylindrical shape. The bobbin 421, in which the cylindrical portion 416 of the magnetic-path forming portion 41 is inserted, is inserted in the through-hole 414 of the top plate 411. The axis of the bobbin 421 defines an axis C2 of the vibrating unit 42.

The voice coil 422 is constituted by conductive wires wound around the outer circumferential surface of the bobbin 421 at one end portion of the bobbin 421 in the axis direction.

The cap 423 is fixed to the bobbin 421 so as to close an opening of the bobbin 421 at the other end portion thereof in the axis direction. The cap 423 is provided with a hole which is formed through the thickness thereof in the axis direction of the bobbin 421 and into which the connecting unit 44 is insertable. The cap 423 is further provided with the above-indicated fixing means 420 for the vibrating unit 42. The fixing means 420 is configured to fix, to the cap 423, the connecting unit 44 inserted in the hole of the cap 423. The fixing means 420 is a chuck device, for instance.

The vibrating unit 42 is attached to the magnetic-path forming portion 41 by the damper portion 45 such that the one end portion of the bobbin 421 around which the voice coil 422 is wound is located in the magnetic space 417 of the magnetic-path forming portion 41 that is formed on the first-opening side of the magnetic-path forming portion 41 (on which the first opening 410A of the insertion hole 410 is located) and such that the other end portion of the bobbin 421 protrudes from the magnetic-path forming portion 41.

The damper portion 45 has a function of supporting the vibrating unit 42 such that the vibrating unit 42 does not contact the magnetic-path forming portion 41. The damper portion 45 further has a function of permitting the axis C2 of the vibrating unit 42 to coincide with the axis C1 of the magnetic-path forming portion 41 and supporting the vibrating unit 42 such that the vibrating unit 42 is displaceable with respect to the magnetic-path forming portion 41 in a direction of extension of the axis C1 of the magnetic-path forming portion 41 (i.e., an axis C1 direction).

The damper portion 45 of the present embodiment has an annular shape. The damper portion 45 has a bellows-like shape waved in its diametrical direction. The damper portion 45 is fixed at its inner periphery to the other end portion of the bobbin 421 and at its outer periphery to the top plate 411. The damper portion 45 is formed of a fiber, a resin material, or the like, so as to be elastically deformable.

In the acoustic transducer 40 including the magnetic-path forming portion 41 and the vibrating unit 42, when an electric current in accordance with an audio signal passes through the voice coil 422 disposed in the magnetic space 417, the vibrating unit 42 vibrates in the axis C1 direction of the magnetic-path forming portion 41. The audio signal is generated in a controller (not shown) as a drive signal for driving the vibrating unit 42, on the basis of audio data stored in a memory (not shown), for instance.

As shown in FIGS. 3 and 4, the connecting unit 44 connects the vibrating unit 42 and the soundboard 16 to each other, so as to transmit vibration of the vibrating unit 42 to the soundboard 16. The connecting unit 44 passes through the insertion hole 410 of the magnetic-path forming portion 41. In the connecting unit 44, a first protruding portion 441 that protrudes from the first opening 410A of the insertion hole 410 is disposed on one-end side of the connecting unit 44 that is located on the first-opening (410A) side of the magnetic-path forming portion 41. The first protruding portion 441 is removably fixed to the vibrating unit 42 by the fixing means 420. In other words, the vibrating unit 42 is disposed on the first-opening (410A) side of the magnetic-path forming portion 41 and is fixed to the connecting unit 44 on the first-opening (410A) side. The first-opening (410A) side is defined as a region that is more distant from the soundboard 16 in the predetermined direction than the magnetic-path forming portion 41, as viewed from the soundboard 16, namely, a region that is located on one of the opposite sides of the magnetic-path forming portion 41 remote from the soundboard 16 in the predetermined direction. In the connecting unit 44, a second protruding portion 442 that protrudes from the second opening 410B of the insertion hole 410 is disposed on the other-end side of the connecting unit 44 that is located on a second-opening side of the magnetic-path forming portion 41. The second-opening (410B) side is the other of the opposite sides of the magnetic-path forming portion 41 and is defined as a region that is nearer to the soundboard 16 in the predetermined direction than the magnetic-path forming portion 41, as viewed from the soundboard 16, namely, a region that is located on the other of the opposite sides of the magnetic-path forming portion 41 nearer to the soundboard 16 in the predetermined direction. A distal end of the second protruding portion 442 in its protrusion direction, which is the other end of the connecting unit 44, is connected to the soundboard 16. In other words, the soundboard 16 is connected to the connecting unit 44 on the second-opening (410B) side.

The connecting unit 44 of the present embodiment includes a rod-like vibrating-side shaft portion 443 that passes through the insertion hole 410 of the magnetic-path forming portion 41, a rod-like vibrated-side shaft portion 444 that protrudes from the soundboard (16) side toward the magnetic-path forming portion 41, and an intermediate joint portion 445 that connects the vibrating-side shaft portion 443 and the vibrated-side shaft portion 444 to each other.

The vibrating-side shaft portion 443 includes the first protruding portion 441 and a proximal end portion of the second protruding portion 442 in its protrusion direction. One end of the vibrating-side shaft portion 443, which corresponds to the first protruding portion 441, extends through the cap 423 of the vibrating unit 42 and is fixed to the cap 423 of the vibrating unit 42 by the fixing means 420. Thus, the axis of the vibrating-side shaft portion 443 coincides with the axis C2 of the vibrating unit 42.

The vibrated-side shaft portion 444 provides a distal end portion of the second protruding portion 442 in its protrusion direction located on the soundboard (16) side.

The intermediate joint portion 445 allows the axis C2 of the vibrating-side shaft portion 443 and an axis C3 of the vibrated-side shaft portion 444 to incline relative to each other. The intermediate joint portion 445 of the present embodiment has the so-called ball joint structure. The intermediate joint portion 445 includes a spherical portion 447 formed at one end of one of the vibrating-side shaft portion 443 and the vibrated-side shaft portion 444 and a retainer portion 448 formed at one end of the other of the vibrating-side shaft portion 443 and the vibrated-side shaft portion 444. The retainer portion 448 rotatably holds the spherical portion 447. In the illustrated example, the spherical portion 447 is formed at one end of the vibrating-side shaft portion 443 while the retainer portion 448 is formed at one end of the vibrated-side shaft portion 444.

A center P1 of the intermediate joint portion 445 (the spherical portion 447) is located on both of the axis C2 of the vibrating-side shaft portion 443 and the axis C3 of the vibrated-side shaft portion 444. Thus, the axis C2 of the vibrating-side shaft portion 443 and the axis C3 of the vibrated-side shaft portion 444 can incline relative to each other about the center P1 of the intermediate joint portion 445. That is, the connecting unit 44 of the present embodiment is bendable at the intermediate joint portion 445.

The connecting unit 44 further includes a distal joint portion 446 disposed at one end of the vibrated-side shaft portion 444 which corresponds to the distal end of the second protruding portion 442 connected to the soundboard 16. The distal joint portion 446 allows the axis C3 of the vibrated-side shaft portion 444 to incline with respect to the predetermined direction (the Y-axis direction).

The distal joint portion 446 of the present embodiment has a ball joint structure similar to that of the intermediate joint portion 445. The distal joint portion 446 includes a spherical portion 449 formed at one end of the vibrated-side shaft portion 444 and a retainer portion 450 fixed to the soundboard 16 and rotatably holding the spherical portion 449.

A center P2 of the distal joint portion 446 (the spherical portion 449) is located on the axis C3 of the vibrated-side shaft portion 444. Thus, the axis C3 of the vibrated-side shaft portion 444 can incline with respect to the predetermined direction (the Y-axis direction) about the center P2 of the distal joint portion 446.

As shown in FIG. 4, the acoustic transducer 40 of the present embodiment has a restrictor 46 engaging with one end of the vibrating-side shaft portion 443 which corresponds to the proximal end portion of the second protruding portion 442. The restrictor 46 is configured to restrict a movement of the vibrating-side shaft portion 443 in a direction intersecting a direction of extension of the axis C2 while allowing a movement of the vibrating-side shaft portion 443 in the direction of extension of the axis C2 (i.e., the axis C2 direction), at a position at which the restrictor 46 engages with the vibrating-side shaft portion 443.

The restrictor 46 of the present embodiment includes a frame portion 461 and a contact member 462.

The frame portion 461 is formed by bending a plate member formed of metal or the like. The frame portion 461 includes: a fixing plate portion 463 that is superposed on and fixed to one end face of the magnetic-path forming portion 41 located on the first-opening (410A) side; an engaging plate portion 464 that is disposed so as to be opposed to another end face of the magnetic-path forming portion 41 located on the second-opening (410B) side; and a connecting plate portion 465 which extends, on the side portion of the magnetic-path forming portion 41, in the direction of extension of the axis C1 of the magnetic-path forming portion 41 and which connects the fixing plate portion 463 and the engaging plate portion 464 to each other.

The fixing plate portion 463 is fixed to the top plate 411. The fixing plate portion 463 is provided with an opening hole 466 that penetrates therethrough in the thickness direction, for preventing the fixing plate portion 463 from interfering with the vibrating unit 42, the first protruding portion 441 of the connecting unit 44, and the damper portion 45 that protrude from the top plate 411. The engaging plate portion 464 is disposed so as to face the disc portion 415 of the yoke 413. The engaging plate portion 464 is provided with a hole that penetrates therethrough in the thickness direction, for permitting the vibrating-side shaft portion 443 to pass through the hole.

The contact member 462 has an annular shape and is formed of a soft fiber member such as felt or cloth. The contact member 462 is fixed by bonding or the like to the inner circumferential surface of the hole of the engaging plate portion 464. The contact member 462 functions as a bushing for filling a clearance between the hole of the engaging plate portion 464 and the vibrating-side shaft portion 443 passing through the hole. That is, the contact member 462 is held in contact with a part of the vibrating-side shaft portion 443 located within the hole of the engaging plate portion 464 and is held in engagement with the vibrating-side shaft portion 443.

The thus constructed restrictor 46 restricts a movement of the vibrating-side shaft portion 443 in a direction perpendicular to the axis C2 direction while allowing a movement of the vibrating-side shaft portion 443 in the axis C2 direction, at the position at which the contact member 462 of the restrictor 46 is held in engagement with the vibrating-side shaft portion 443.

Referring next to FIGS. 1 to 8, the installation structure for installing the acoustic transducer 40 constructed as described above on the piano 1 will be explained.

Figure 2:
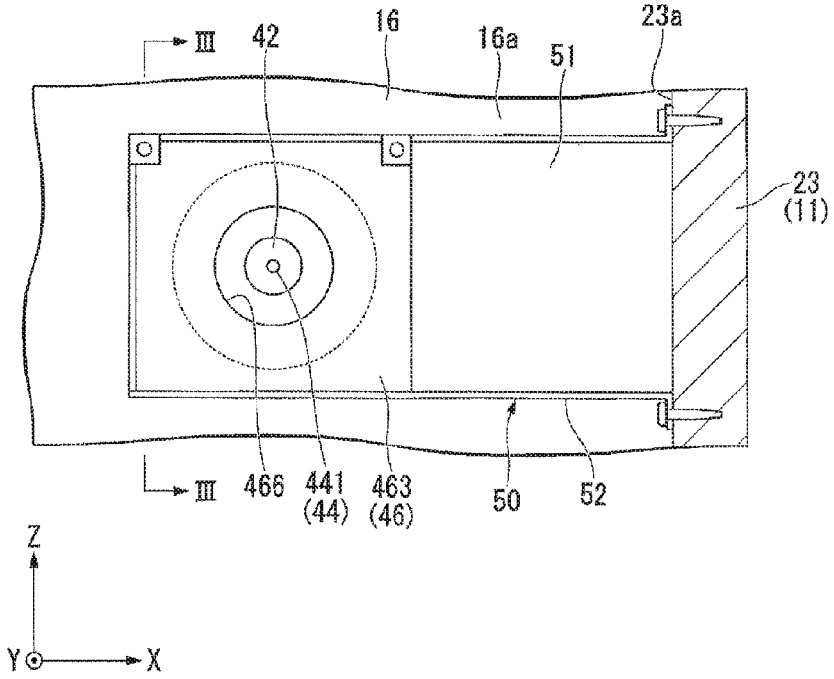
FIG. 2 is a plan view of a structure for fixing a magnetic-path forming portion of the acoustic transducer to the piano shown in FIG. 1, as seen from a player's side of the piano.

As shown in FIGS. 1 to 3, the magnetic-path forming portion 41 of the acoustic transducer 40 is fixed to the housing 11 as a support portion for fixation. The magnetic-path forming portion 41 is fixed to the housing 11 such that the second opening 410B (FIG. 4) of the insertion hole 410 is opposed to the inner surface 16*a* or an outer surface 16*b* of the soundboard 16 as a major surface thereof and such that the axis C2 of the magnetic-path forming portion 41 extends in parallel with the predetermined direction (the Y-axis direction) which is perpendicular to the major surface of the soundboard 16. Further, the magnetic-path forming portion 41 is fixed to the housing 11 such that the vibrating unit 42 protrudes from the magnetic-path forming portion 41 in a direction away from the major surface of the soundboard 16.

In the present embodiment, the magnetic-path forming portion 41 is disposed in the housing 11 so as to be opposed to the inner surface 16*a* of the soundboard 16. In the present embodiment, the magnetic-path forming portion 41 is disposed in a region of the housing 11 which is located between the lower front panel 19 and the soundboard 16. Further, the magnetic-path forming portion 41 is fixed to the housing 11 via a support portion 50. The support portion 50 is fixed to the side board 23 of the housing 11 and extends from an inner surface 23*a* of the side board 23 in the X-axis direction.

The support portion 50 in the present embodiment is formed by bending a plate member formed of metal or the like. The support portion 50 includes a positioning plate portion 51 disposed between the soundboard 16 and the magnetic-path forming portion 41 and a support plate portion 52 that supports the magnetic-path forming portion 41 from the lower side of the magnetic-path forming portion 41 in the vertical direction. The positioning plate portion 51 is provided with an opening hole 53 that penetrates therethrough in the thickness direction for permitting the connecting unit 44 of the acoustic transducer 40 to pass through the opening hole 53.

The magnetic-path forming portion 41 is fixed by screwing or the like to the support portion 50 constructed as described above. The magnetic-path forming portion 41 is pressed onto the positioning plate portion 51 and is placed on the support plate portion 52, whereby the magnetic-path forming portion 41 is positioned relative to the housing 11 and the soundboard 16.

In the present embodiment, the engaging plate portion 464 of the frame portion 461 is interposed between the magnetic-path forming portion 41 and the positioning plate portion 51, so that the engaging plate portion 464 is pressed onto the positioning plate portion 51. The connecting plate portion 465 of the frame portion 461 is interposed between the magnetic-path forming portion 41 and the support plate portion 52, so that the connecting plate portion 465 is placed on the support plate portion 52.

The vibrating unit 42 of the acoustic transducer 40 is connected, via the connecting unit 44, to the inner surface 16*a* of the soundboard 16 as its major surface. The position at which the connecting unit 44 is connected to the soundboard 16 is preferably determined to be a position at which the soundboard 16 is sandwiched by and between the connecting unit 44 and the soundboard rib 36 provided on the outer surface 16*b* of the soundboard 16, for instance.

In the present embodiment, the retainer portion 450 of the distal joint portion 446, which is provided at one end of the vibrated-side shaft portion 444 that corresponds to the distal end of the second protruding portion 442 of the connecting unit 44, is fixed to the inner surface 16*a* of the soundboard 16. Further, in the present embodiment, an intervening member 60 is provided between the retainer portion 450 and the soundboard 16, and the retainer portion 450 is fixed to the soundboard 16 via the intervening member 60.

The intervening member 60 is undetachably fixed to the soundboard 16 by bonding and is detachably fixed to the connecting unit 44. The intervening member 60 is shaped like a plate and is disposed such that the thickness direction of the intervening member 60 coincides with the predetermined direction (the Y-axis direction).

As shown in FIGS. 3 and 5 to 7, the intervening member 60 is provided with a positioning recess 63A which is recessed from its first facing surface 61 that faces the retainer portion 450 of the distal joint portion 446. In the present embodiment, the positioning recess 63A penetrates the intervening member 60 in the thickness direction. The retainer portion 450 is provided with a positioning protrusion 63B which protrudes toward the intervening member 60 and which is insertable in the positioning recess 63A in the predetermined direction. The positioning protrusion 63B is fitted into the positioning recess 63A with no clearance formed therebetween. Thus, the retainer portion 450 that corresponds to the distal end of the connecting unit 44 is positioned relative to the intervening member 60.

The intervening member 60 is provided with internally threaded holes 65 into which screws 64 are screwed for fixing and fastening the retainer portion 450 to the intervening member 60. Each internally threaded hole 65 is formed through the thickness of the intervening member 60. A plurality of internally threaded holes 65 (three internally threaded holes 65 in the illustrated example) are formed so as to be spaced apart from one another in the circumferential direction of the intervening member 60.

The intervening member 60 is further provided with screw insertion holes 67 into which screws 66 are screwed for fixing and fastening the intervening member to the soundboard 16. A plurality of screw insertion holes 67 (three screw insertion holes 67 in the illustrated example) are formed so as to be spaced apart from one another in the circumferential direction of the intervening member 60.

The internally threaded holes 65 and the screw insertion holes 67 are alternately disposed in the circumferential direction of the intervening member 60.

A second facing surface 62 of the intervening member 60 that faces the soundboard 16 includes a bonding region 62*a* which is bonded to the soundboard 16 by an adhesive (not shown) and a non-bonding region 62*b* which is not bonded to the soundboard 16. A wetting preventive structure 62C is formed on the second facing surface 62 for preventing the adhesive that leaks from the bonding region 62*a* from spreading over the non-bonding region 62*b*. The wetting preventive structure 62C of the present embodiment is constituted by a stepped structure which is formed on the second facing surface 62 such that the non-bonding region 62*b* is located at a height level lower than the bonding region 62*a*. The non-bonding region 62*b* includes regions of the second facing surface 62 in which the positioning recess 63A, the internally threaded holes 65, and the screw insertion holes 67 are open.

There will be next explained a method of installing the acoustic transducer 40 of the present embodiment on the piano 1.

When installing the acoustic transducer 40 on the piano 1, an intervening-member fixing step is first performed for fixing the intervening member 60 to the soundboard 16. In this step, an adhesive is applied to the bonding region 62*a* of the second facing surface 62 of the intervening member 60, and the second facing surface 62 of the intervening member 60 is pressed onto the inner surface 16*a* of the soundboard 16. Thus, the intervening member 60 is undetachably fixed to the soundboard 16.

In the present embodiment, the non-bonding region 62*b* of the second facing surface 62 of the intervening member 60 is located at a height level lower than the bonding region 62*a* owing to the wetting preventive structure 62C. Consequently, even if the adhesive overflows the bonding region 62*a* and spreads toward the non-bonding region 62*b* when the intervening member 60 is pressed onto the soundboard 16, the adhesive is prevented from entering the positioning recess 63A, the internally threaded holes 65, and the screw insertion holes 67 which are open in the non-bonding region 62*b*.

In the present embodiment, after the intervening member 60 has been bonded and fixed to the soundboard 16, the screws 66 are inserted into the respective screw insertion holes 67 of the intervening member 60 and are screwed to the soundboard 16, whereby the intervening member 60 is fixed and fastened to the soundboard 16.

Before or after the intervening-member fixing step, a support-portion fixing step is performed for fixing the support portion 50 to the housing 11. In one of the intermediate-member fixing step and the support-portion fixing step which is later performed, the intervening member 60 and the support portion 50 are preferably positioned relative to each other using a jig not shown. In particular, the intervening member 60 and the support portion 50 are preferably positioned relative to each other in the direction (the X-axis direction and the Z-axis direction) perpendicular to the predetermined direction (the Y-axis direction).

Subsequently, a connecting-unit fixing step is performed for fixing the connecting unit 44 to the intervening member 60. In this step, the retainer portion 450 of the distal joint portion 446 is initially disposed so as to be superposed on the first facing surface 61 of the intervening member 60. In this instance, the positioning protrusion 63B of the retainer portion 45 is fitted into the positioning recess 63A of the intervening member 60, whereby the retainer portion 450 is positioned relative to the intervening member 60. Thereafter, the screws 64 are inserted so as to pass through the retainer portion 450 and are screwed into the internally threaded holes 65 of the intervening member 60. Thus, the retainer portion 450 is fastened and fixed to the intervening member 60. In a state after this step has been performed, the vibrating-side shaft portion 443 of the connecting unit 44 passes through the opening hole 53 of the positioning plate portion 51 of the support portion 50.

After the connecting-unit fixing step has been performed, a vibrating-unit fixing step is performed for fixing the vibrating unit 42 to the connecting unit 44. Further, a magnetic-path-forming-portion fixing step is performed for fixing the magnetic-path forming portion 41 to the support portion 50. The order of performing these two steps is not limited. For instance, these two steps may be performed in parallel with each other.

In the vibrating-unit fixing step, the vibrating-side shaft portion 443 of the connecting unit 44 is inserted into the opening of the engaging plate portion 464 of the frame portion 461 integrally fixed to the magnetic-path forming portion 41, the insertion hole 410 of the magnetic-path forming portion 41, and the opening of the vibrating unit 42 (the cap 423) in this order. Subsequently, one end of the vibrating-side shaft portion 443, which corresponds to the first protruding portion 441 of the connecting unit 44, is fixed to the vibrating unit 42 by the fixing means 420. In this state, the axis of the vibrating-side shaft portion 443 coincides with the axis C1 of the vibrating unit 42.

In the magnetic-path-forming-portion fixing step, the connecting plate portion 465 of the frame portion 461 integrally fixed to the magnetic-path forming portion 41 is placed on the support plate portion 52 of the support portion 50, and the engaging plate portion 464 of the frame portion 461 is disposed so as to be superposed on the positioning plate portion 51 of the support portion 50. Thus, the magnetic-path forming portion 41 is positioned relative to the housing 11, the soundboard 16, and the connecting unit 44. Thereafter, the frame portion 461 is fixed to the support portion 50 by screwing or the like, whereby the magnetic-path forming portion 41 is fixed to the support portion 50.

In this wary, the acoustic transducer 40 is installed on the piano 1.

In the installation method described above, the intervening member 60 fixed to the soundboard 16 and the support portion 50 fixed to the housing 11 are positioned relative to each other, and the magnetic-path forming portion 41 is positioned relative to the support portion 50, so that the axis C1 of the magnetic-path forming portion 41 is made parallel to the predetermined direction (the Y-axis direction), as shown in FIG. 3. Further, the axis C1 of the magnetic-path forming portion 41, the axis C2 of the vibrating unit 42, the axis of the vibrating-side shaft portion 443 of the connecting unit 44, and the axis C3 of the vibrated-side shaft portion 444 coincide with one another.

When a drive signal based on an audio signal is input to the voice coil 422 of the acoustic transducer 40 in the piano 1 on which the acoustic transducer 40 is installed as described above, the vibrating unit 42 vibrates in the predetermined direction. The vibration of the vibrating unit 42 is transmitted to the soundboard 16 by the connecting unit 44, so that the soundboard 16 vibrates in the predetermined direction. The vibration of the soundboard 16 propagates in the air, so that sounds are generated.

Figure 8:
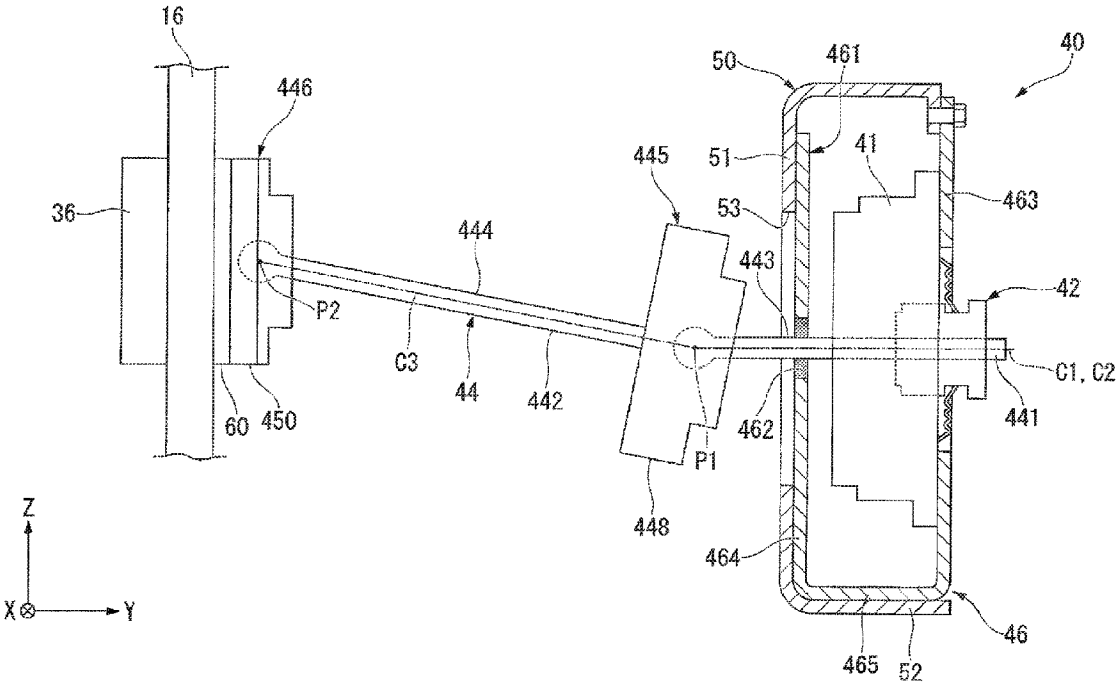
FIG. 8 is a view showing a state in which the installation structure for the acoustic transducer shown in FIG. 3 has suffered from deterioration over years.

In an instance where the piano 1 on which the acoustic transducer 40 is installed undergoes displacement of the soundboard 16 in a direction perpendicular to the predetermined direction due to deterioration over years, for instance, specifically, in an instance where the soundboard 16 undergoes displacement in the Z-axis direction as shown in FIG. 8, the intervening member 60 and the retainer portion 450 of the distal joint portion 446 which are fixed to the soundboard 16 are also displaced in the Z-axis direction with respect to the magnetic-path forming portion 41.

In the present embodiment, the connecting unit 44 includes the intermediate joint portion 445 and the distal joint portion 446. When the intervening member 60 and the retainer portion 450 of the distal joint portion 446 are displaced in the Z-axis direction, the axis C3 of the vibrated-side shaft portion 444 is inclined by the intermediate joint portion 445 and the distal joint portion 446 with respect to both of the predetermined direction and the axis C2 of the magnetic-path forming portion 41. It is consequently possible to prevent the axes of the vibrating unit 42 and the vibrating-side shaft portion 443 from being inclined with respect to the predetermined direction. That is, it is possible to prevent the axis C2 of the vibrating unit 42 fixed to the vibrating-side shaft portion 443 from being inclined with respect to the axis C1 of the magnetic-path forming portion 41 that is parallel to the predetermined direction.

According to the present installation structure for the acoustic transducer 40 and the piano 1 equipped with the same, the magnetic-path forming portion 41 is disposed such that the vibrating unit 42 protrudes from the magnetic-path forming portion 41 in a direction away from the soundboard 16. In other words, the acoustic transducer 40 is disposed with respect to the soundboard 16 such that its orientation is inverted or reversed with respect to an orientation in which acoustic transducers are conventionally disposed. In the thus oriented acoustic transducer 40, the vibrating unit 42 and the soundboard 16 are connected by the connecting unit 44 that passes through the insertion hole 410 of the magnetic-path forming portion 41. In the present installation structure, it is possible to increase a distance between a position at which the vibrating unit 42 is attached to the magnetic-path forming portion 41 and a position at which the vibrating unit 42 (the connecting unit 44) is connected to the soundboard 16, as compared with a conventional arrangement. Thus, even when the soundboard 16 undergoes displacement in the perpendicular direction (the X-axis direction, the Z-axis direction) due to deterioration over years, it is possible to reduce a displacement amount of the vibrating unit 42 with respect to the magnetic-path forming portion 41.

Hereinafter, the advantages described above will be concretely explained in terms of the structure according to the present embodiment.

When the soundboard 16 undergoes displacement in the Z-axis direction, the intermediate joint portion 445 of the connecting unit 44 may also be displaced in the Z-axis direction though a displacement amount of the intermediate joint portion 445 is smaller than that of the soundboard 16 in the Z-axis direction. Consequently, the axis C2 of the vibrating-side shaft portion 443 and the vibrating unit 42 may be inclined with respect to the axis C1 of the magnetic-path forming portion 41.

In the installation structure of the present embodiment, the acoustic transducer 40 is disposed with respect to the soundboard 16 such that its orientation is inverted or reversed with respect to the conventional orientation. It is thus possible to increase a length of the vibrating-side shaft portion 443 extending from the vibrating unit 42 to the intermediate joint portion 445, as compared with the conventional arrangement. Consequently, an inclination angle (displacement amount) of the axis C2 of the vibrating-side shaft portion 443 and the vibrating unit 42 with respect to the axis C1 of the magnetic-path forming portion 41 can be made smaller, as compared with the conventional arrangement.

According to the installation structure of the present embodiment, one end of the vibrating-side shaft portion 443, which corresponds to the first protruding portion 441 of the connecting unit 44, is supported by the damper portion 45 together with the vibrating unit 42, and another end of the vibrating-side shaft portion 443, which corresponds to the second protruding portion 442 of the connecting unit 44, is supported by the restrictor 46. In other words, the vibrating-side shaft portion 443 of the connecting unit 44 is supported at mutually different two locations on its axis. Consequently, even if a distance between the magnetic-path forming portion 41 and the soundboard 16 is small, it is possible to increase a distance between a portion of the vibrating-side shaft portion 443 at which the vibrating-side shaft portion 443 is supported by the damper portion 45 and a portion of the vibrating-side shaft portion 443 at which the vibrating-side shaft portion 443 is supported by the restrictor 46.

Consequently, even when the soundboard 16 undergoes displacement in the Z-axis direction and an external force to incline the axis C2 of the vibrating-side shaft portion 443 with respect to the axis C1 of the magnetic-path forming portion 41 acts on the vibrating-side shaft portion 443, the damper portion 45 and the restrictor 46 prevent the vibrating-side shaft portion 443 from being inclined. Thus, it is possible to further reduce the displacement amount of the vibrating unit 42 with respect to the magnetic-path forming portion 41.

According to the installation structure of the present embodiment, the connecting unit 44 includes the intermediate joint portion 445 and the distal joint portion 446. When the soundboard 16 undergoes displacement in the Z-axis direction, the vibrated-side shaft portion 444 inclines with respect to both of the predetermined direction and the axis C2 of the vibrating-side shaft portion 443. As a result, it is possible to prevent the axis C2 of the vibrating-side shaft portion 443 and the vibrating unit 42 fixed to the vibrating-side shaft portion 443 from being inclined with respect to the axis C1 of the magnetic-path forming portion 41. Consequently, it is possible to further reduce the displacement amount of the vibrating unit 42 with respect to the magnetic-path forming portion 41.

The reduction in the displacement amount of the vibrating unit 42 with respect to the magnetic-path forming portion 41 causes a reduction in position deviation of the voice coil 422 of the vibrating unit 42 with respect to the magnetic space 417 of the magnetic-path forming portion 41. It is consequently possible to prevent noise from being mixed in sounds based on the vibration of the soundboard 16 which is vibrated by the acoustic transducer 40.

According to the installation structure of the present embodiment, the vibrating unit 42 is removably fixed to the first protruding portion 441 of the connecting unit 44. In other words, a position at which the vibrating unit 42 and the connecting unit 44 are fixed is not located between the magnetic-path forming portion 41 and the soundboard 16, whereby the magnetic-path forming portion 41 and the vibrating unit 42 can be easily attached to and removed from the connecting unit 44. Consequently, installation of the acoustic transducer 40 on the piano 1 and maintenance of the acoustic transducer 40 can be easily performed.

According to the installation structure and the installation method of the present embodiment, the intervening member 60 is disposed between the connecting unit 44 of the acoustic transducer 40 and the soundboard 16, and the intervening member 60 is attachable to and detachable from the connecting unit 44, so that it is possible to fix only the intervening member 60 to the soundboard 16. Further, the intervening member 60 is easily formed so as to have a small size and weight, as compared with the acoustic transducer 40. Consequently, the intervening member 60 can be pressed onto the soundboard 16 with high stability when the intervening member 60 is fixed to the soundboard 16 by bonding. It is thus possible to fix the intervening member 60 to the soundboard 16 while the intervening member is held in close contact with the soundboard 16. In this arrangement, the vibration of the vibrating unit 42 can be suitably transmitted to the soundboard 16, so that sounds generated from the soundboard 16 that is vibrated by the acoustic transducer 40 can be suitably obtained.

Further, the connecting unit 44 of the acoustic transducer 40 is detachably fixed to the intervening member 60, whereby the entirety of the acoustic transducer 40 including the connecting unit 44 can be easily removed from the soundboard 16. It is possible to easily perform a maintenance checkup of the acoustic transducer 40.

According to the installation structure of the present embodiment, when the connecting unit 44 is attached to the intervening member 60 fixed to the soundboard 16, the connecting unit 44 is easily positioned relative to the intervening member 60 by inserting the positioning protrusion 63B formed at the retainer portion 450 of the distal joint portion 446 of the connecting unit 44 into the positioning recess 63A formed in the intervening member 60. That is, the connecting unit 44 can be easily attached to the intervening member 60.

According to the installation structure of the present embodiment, the non-bonding region 62*b*, which is provided on the second facing surface 62 of the intervening member 60 that faces the soundboard 16, is located at a height level lower than the bonding region 62*a*. In this arrangement, even if the adhesive between the intervening member 60 and the soundboard 16 leaks from the bonding region 62*a* toward the non-bonding region 62*b* when the intervening member 60 is pressed onto the soundboard 16 for bonding and fixing the intervening member 60 to the soundboard 16, the adhesive is prevented from entering the positioning recess 63A, the internally threaded holes 65, and the screw insertion holes 67 which are open in the non-bonding region 62*b*. It is consequently possible to prevent the adhesive from causing any trouble when the intervening member 60 is fastened and fixed to the soundboard 16 by the screws 66 and when the connecting unit 44 is fastened and fixed to the intervening member 60 by the screws 64.

While the embodiment of the present invention has been explained in detail, it is to be understood that the present invention is not limited to the details of the illustrated embodiment, but may be embodied with various changes without departing from the scope of the invention.

In the illustrated embodiment, the positioning recess 63A is formed in the intervening member 60 while the positioning protrusion 63B is provided at the retainer portion 450 of the distal joint portion 446. For instance, the positioning recess 63A may be formed in the retainer portion 450 while the positioning protrusion 63B may be provided at the intervening member 60.

The wetting preventive structure 62C formed on the second facing surface 62 of the intervening member 60 is not limited to the stepped structure of the illustrated embodiment in which the non-bonding region 62*b* is located at a height level lower than the bonding region 62*a*. For instance, the wetting preventive structure may be constituted by a groove formed between the bonding region 62*a* and the non-bonding region 62*b*. In this case, the bonding region 62*a* and the non-bonding region 62*b* may be located at the same height level.

Such a structure also offers advantages similar to those in the illustrated embodiment. That is, even if the adhesive between the intervening member 60 and the soundboard 16 leaks from the bonding region 62*a* toward the non-bonding region 62*b* when the intervening member 60 is pressed onto the soundboard 16 for fixing the intervening member 60 to the soundboard 16 by bonding, the adhesive flows in the groove. It is consequently possible to prevent the adhesive from entering the positioning recess 63A, the internally threaded holes 65, and the screw insertion holes 67 which are open in the non-bonding region 62*b*.

The intermediate joint portion 445 and the distal joint portion 446 of the connecting unit 44 may have any structure other than the ball joint structure of the illustrated embodiment. For instance, the intermediate joint portion 445 and the distal joint portion 446 may have a universal joint structure.

Figure 9:
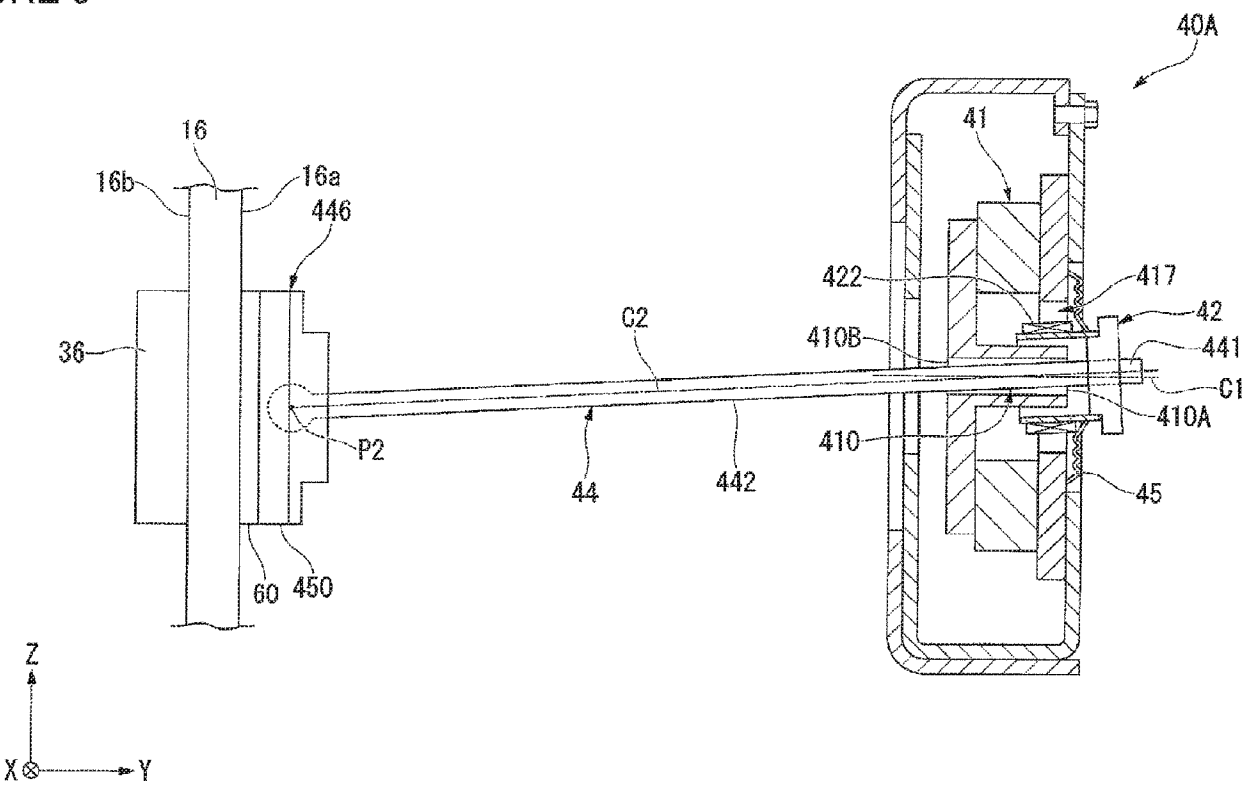
FIG. 9 is a cross-sectional view of an installation structure for the acoustic transducer according to another embodiment, the view showing a state in which the installation structure for the acoustic transducer has suffered from deterioration over years.

It is not necessarily required for the connecting unit 44 to have the intermediate joint portion 445, as shown in FIG. 9. That is, the connecting unit 44 may be constituted by a rod-like member. An acoustic transducer 40A shown in FIG. 9 does not include the restrictor 46. The magnetic-path forming portion 41 of the acoustic transducer 40A is fixed to the housing 11 by the support portion 50 (FIGS. 2 and 3), as in the illustrated embodiment. In the acoustic transducer 40A shown in FIG. 9, the first protruding portion 441 of the connecting unit 44, which protrudes from the first opening 410A of the insertion hole 410 of the magnetic-path forming portion 41, is fixed to the vibrating unit 42, as in the acoustic transducer 40 of the illustrated embodiment. Further, a distal end of the second protruding portion 442 of the connecting unit 44, which protrudes from the second opening 410B of the insertion hole 410, is connected to the soundboard 16.

In the installation structure for the acoustic transducer 40A shown in FIG. 9, when the soundboard 16 undergoes displacement in the Z-axis direction due to deterioration over years and the intervening member 60 and the retainer portion 450 of the distal joint portion 446 which are fixed to the soundboard 16 are also displaced in the Z-axis direction, the axis C2 of the connecting unit 44 and the vibrating unit 42 is inclined by the distal joint portion 446 with respect to both of the predetermined direction and the axis C1 of the magnetic-path forming portion 41.

Like the acoustic transducer 40 of the illustrated embodiment, the acoustic transducer 40A shown in FIG. 9 is disposed with respect to the soundboard 16 such that its orientation is inverted or reversed with respect to the conventional orientation. It is thus possible to increase a distance between a position at which the vibrating unit 42 is attached to the magnetic-path forming portion 41 and a position at which the vibrating unit 42 (the connecting unit 44) is connected to the soundboard 16, as compared with the conventional arrangement. Consequently, the acoustic transducer 40A shown in FIG. 9 makes it possible to reduce an inclination angle (displacement amount) of the axis C2 of the connecting unit 44 and the vibrating unit 42 with respect to the axis C1 of the magnetic-path forming portion 41.

The connecting unit 44 may be fixed to the soundboard 16 such that the axis C2 of the connecting unit 44 is kept parallel to the predetermined direction, without including the intermediate joint portion 445 and the distal joint portion 446.

The acoustic transducer 40, 40A need not be necessarily disposed within the housing 11, but may be disposed so as to be exposed to an exterior of the housing 11, for instance. That is, the acoustic transducer 40, 40A need not be necessarily connected to the inner surface 16*a* of the soundboard 16 as in the illustrated embodiment, but may be connected to the outer surface 16*b* of the soundboard 16 that faces toward the exterior of the housing 11. In this case, the position at which the acoustic transducer 40, 40A is connected to the soundboard 16 may be determined to be a position at which the soundboard 16 is sandwiched between the acoustic transducer 40, 40A and the bridge 35 without interfering with the soundboard ribs 36.

In the illustrated embodiment, the soundboard 16 is illustrated as one example of the vibrated body which is to be vibrated and on which the acoustic transducer 40, 40A is installed. The vibrated body may be other members of the housing 11 that may undergo displacement due to deterioration over years, such as the rear roof 24 and the side boards 23.

The installation structure for the acoustic transducer 40, 40A according to the present invention is applicable to a structure in which the vibrated body does not undergo displacement and the member of the housing 11 to which the magnetic-path forming portion 41 is fixed may undergo displacement due to deterioration over years.

The installation structure for the acoustic transducer 40, 40A according to the present invention is applicable to musical instruments having the vibrated body such as the soundboard 16. For instance, the installation structure for the acoustic transducer 40, 40A is applicable to various musical instruments including other keyboard musical instruments such as grand pianos, stringed musical instruments such as acoustic guitars and violins, and percussion instruments such as drums and timpani.

The illustrated embodiment may be considered that the following invention is embodied: An installation structure for an acoustic transducer configured to vibrate a vibrated body in a first direction so as to permit the vibrated body to generate sounds, wherein the acoustic transducer includes: a magnetic-path forming portion that forms a magnetic path; a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the magnetic-path forming portion has a through-hole penetrating therethrough in the first direction from a first opening to a second opening, the connecting unit passing through the through-hole, wherein the connecting unit is fixed to the vibrating unit on a first-opening side of the magnetic-path forming portion which is one of opposite sides of the magnetic-path forming portion on which the first opening is located, and wherein the connecting unit is connected to vibrated body on a second-opening side of the magnetic-path forming portion which is the other of the opposite sides of the magnetic-path forming portion on which the second opening is located.

EXPLANATION OF REFERENCE SIGNS

1: piano (musical instrument) 16: soundboard (vibrated body) 40, 40A: acoustic transducer 41: magnetic-path forming portion 410: insertion hole 410A: first opening 410B: second opening 42: vibrating unit 44: connecting unit 441: first protruding portion 442: second protruding portion 443: vibrating-side shaft portion 444: vibrated-side shaft portion 445: intermediate joint portion 446: distal joint portion 45: damper portion 46: restrictor C1, C2, C3: axes

The invention claimed is:

1. An installation structure for an acoustic transducer configured to vibrate a vibrated body in a first direction so as to permit the vibrated body to generate sounds, wherein the acoustic transducer includes:

a magnetic-path forming portion that forms a magnetic path, the magnetic-path forming portion including a first-opening side and a second-opening side, the second opening side located at an opposite end of the magnetic-path forming portion from the first opening-side, wherein the magnetic-path forming portion includes a through-hole penetrating therethrough in the first direction from a first opening on the first-opening side to a second opening on the second-opening side;

a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the connecting unit passes through the through-hole, wherein the vibrating unit is disposed on the first-opening side of the magnetic-path forming portion and the vibrating unit is connected to the connecting unit on the first-opening side of the magnetic-path forming portion, and wherein the vibrated body is disposed on the second-opening side of the magnetic-path forming portion and connected to the connecting unit on the second-opening side of the magnetic-path forming portion.

2. The installation structure for the acoustic transducer according to claim 1, wherein the vibrating unit is connected to a first protruding portion of the connecting unit that protrudes from the first opening, wherein the connecting unit includes a second protruding portion that protrudes from the second opening, the second protruding portion including a proximal end and a distal end, the proximal end located closer to the second opening than the distal end; and wherein the vibrated body is connected to the distal end of the second protruding portion of the connecting unit.

3. The installation structure for the acoustic transducer according to claim 2, wherein the vibrating unit is removably connected to the first protruding portion.

4. The installation structure for the acoustic transducer according to claim 1, wherein the vibrating unit is supported by the magnetic-path forming portion through a damper portion on the first-opening side of the magnetic-path forming portion.

5. The installation structure for the acoustic transducer according to claim 2, wherein the acoustic transducer further includes a restrictor that is held in engagement with the second protruding portion that protrudes from the second opening, the restrictor being configured to restrict a movement of the second protruding portion in a direction intersecting the first direction while allowing a movement of the second protruding portion in the first direction, at a position at which the restrictor is held in engagement with the second protruding portion.

6. The installation structure for the acoustic transducer according to claim 2, wherein the connecting unit includes a distal joint portion provided at the distal end of the second protruding portion to which the vibrated body is connected, the distal joint portion being configured to allow an axis of the connecting unit to incline with respect to the first direction.

7. The installation structure for the acoustic transducer according to claim 2, wherein the second protruding portion of the connecting unit includes a proximal end portion and a distal end portion, and wherein the connecting unit includes:

a vibrating-side shaft portion passing through the through-hole of the magnetic-path forming portion and including the first protruding portion and the proximal end portion of the second protruding portion;

a vibrated-side shaft portion protruding from the vibrated body toward the magnetic-path forming portion and including the distal end portion of the second protruding portion; and an intermediate joint portion connecting the vibrating-side shaft portion and the vibrated-side shaft portion to each other and configured to allow an axis of the vibrating-side shaft portion and an axis of the vibrated-side shaft portion to incline relative to each other.

8. An installation structure for an acoustic transducer configured to vibrate a vibrated body in a first direction so as to permit the vibrated body to generate sounds, wherein the acoustic transducer includes:

a magnetic-path forming portion that forms a magnetic path, the magnetic-path forming portion including a first-opening side and a second-opening side, the second opening side located at an opposite end of the magnetic-path forming portion from the first opening-side, wherein the magnetic-path forming portion includes a through-hole penetrating therethrough in the first direction from a first opening on the first-opening side to a second opening on the second-opening side;

a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the connecting unit passes through the through-hole, wherein the connecting unit is connected to the vibrating unit on the first-opening side of the magnetic-path forming portion, and wherein the connecting unit is connected to the vibrated body on the second-opening side of the magnetic-path forming portion.

9. The installation structure for the acoustic transducer according to claim 8, wherein the vibrating unit is connected to a first protruding portion of the connecting unit that protrudes from the first opening, wherein the connecting unit includes a second protruding portion that protrudes that protrudes from the second opening, the second protruding portion including a proximal end and a distal end, the proximal end located closer to the second opening than the distal end; and wherein the vibrated body is connected to the distal end of the second protruding portion of the connecting unit.

10. The installation structure for the acoustic transducer according to claim 9, wherein the vibrating unit is removably connected to the first protruding portion.

11. The installation structure for the acoustic transducer according to claim 8, wherein the vibrating unit is supported by the magnetic-path forming portion through a damper portion on the first-opening side of the magnetic-path forming portion.

12. The installation structure for the acoustic transducer according to claim 9, wherein the acoustic transducer further includes a restrictor that is held in engagement with the second protruding portion that protrudes from the second opening, the restrictor being configured to restrict a movement of the second protruding portion in a direction intersecting the first direction while allowing a movement of the second protruding portion in the first direction, at a position at which the restrictor is held in engagement with the second protruding portion.

13. The installation structure for the acoustic transducer according to claim 9, wherein the connecting unit includes a distal joint portion provided at the distal end of the second protruding portion to which the vibrated body is connected, the distal joint portion being configured to allow an axis of the connecting unit to incline with respect to the first direction.

14. The installation structure for the acoustic transducer according to claim 9, wherein the second protruding portion of the connecting unit includes a proximal end portion and a distal end portion, and wherein the connecting unit includes:

a vibrating-side shaft portion passing through the through-hole of the magnetic-path forming portion and including the first protruding portion and the proximal end portion of the second protruding portion;

a vibrated-side shaft portion protruding from the vibrated body toward the magnetic-path forming portion and including the distal end portion of the second protruding portion; and an intermediate joint portion connecting the vibrating-side shaft portion and the vibrated-side shaft portion to each other and configured to allow an axis of the vibrating-side shaft portion and an axis of the vibrated-side shaft portion to incline relative to each other.

15. A musical instrument, comprising:

a vibrated body configured to generate sounds by vibration thereof in the first direction; and an installation structure for an acoustic transducer, wherein the acoustic transducer includes:

a magnetic-path forming portion that forms a magnetic path, the magnetic-path forming portion including a first-opening side and a second-opening side, the second opening side located at an opposite end of the magnetic-path forming portion from the first opening-side, wherein the magnetic-path forming portion includes a through-hole penetrating therethrough in the first direction from a first opening on the first-opening side to a second opening on the second-opening side;

a vibrating unit configured to vibrate in the first direction with respect to the magnetic-path forming portion; and a connecting unit that connects the vibrating unit and the vibrated body to each other, the connecting unit being configured to transmit vibration of the vibrating unit to the vibrated body, wherein the connecting unit passes through the through-hole, wherein the vibrating unit is disposed on the first-opening side of the magnetic-path forming portion and connected to the connecting unit on the first-opening side of the magnetic-path forming portion, and wherein the vibrated body is disposed on the second-opening side of the magnetic-path forming portion and connected to the connecting unit on the second-opening side of the magnetic-path forming portion.

* * * * *